US007631959B2

(12) United States Patent
Chen

(10) Patent No.: US 7,631,959 B2
(45) Date of Patent: Dec. 15, 2009

(54) INK JET HEAD STRUCTURE AND ADHERING METHOD THEREOF

(75) Inventor: Chia-Tai Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 496 days.

(21) Appl. No.: 11/543,838

(22) Filed: Oct. 6, 2006

(65) Prior Publication Data

US 2008/0024564 A1 Jan. 31, 2008

(30) Foreign Application Priority Data

Jul. 28, 2006 (TW) ..... 95127865 A

(51) Int. Cl.
*B41J 2/045* (2006.01)

(52) U.S. Cl. ..... 347/71

(58) Field of Classification Search ..... 347/56, 347/14, 15, 9, 46, 54, 62–64, 65, 68, 69–71, 347/130

See application file for complete search history.

(56) References Cited

U.S. PATENT DOCUMENTS 6,584,687 B1 7/2003 Yamamoto et al.

*Primary Examiner*—K. Feggins
(74) *Attorney, Agent, or Firm*—Birch, Stewart, Kolasch & Birch, LLP

(57) ABSTRACT

An ink jet head structure and an adhering method thereof are provided. The ink jet head structure has ink accommodated therein, and the ink is jetted with the operation of the actuator. The ink jet head structure includes a first substrate, a second substrate, and a third substrate sandwiched between the first and the second substrates. A first fluid passage is formed between the first and the third substrates, and a second fluid passage is formed between the second and the third substrates. By injecting glue between the first and the second fluid passages, the first, second and third substrates are bonded. When the actuator operates, the reservoir disposed in the three substrates may jet the ink accommodated therein from the ink outlet thereof, thereby achieving the purpose of easy bonding and ink jetting.

15 Claims, 26 Drawing Sheets

INK JET HEAD STRUCTURE AND ADHERING METHOD THEREOF

BACKGROUND OF THE INVENTION

1. Field of Invention

The present invention relates to an ink jet head structure and an adhering method thereof, wherein a fluid passage of preset pattern is manufactured on the ink jet head structure and is filled with glue, so as to make multiple layers of structures adhered with each other.

2. Related Art

Along with the rapid development of science and technology, computer apparatus have become indispensable in work or daily life. Accordingly, ink jet printers have become popular computer peripherals widely used in families, companies and related electronic industry of microdrop. The ink jet head element is a key part of the ink jet printer, and the most commonly seen ink jet heads are mainly classified into thermal bubble type and micro piezo type, wherein the micro piezo type ink jet head has no chemical changes due to high temperature or vaporization, and thus is most frequently used in general ink jet printers. The working principle of the micro piezo type ink jet head is that the piezo ceramic is deformed due to applied voltage, and the ink is jetted by the high pressure generated by pressing the ink due to the deformation.

As the strain generated during the operation of the micro piezo type ink jet head is not large, a special design of fluid passage is required to jet the microdrop. In the conventional manufacturing method of the micro piezo type ink jet head, a plurality of preprocessed plates is stacked sequentially and bonded by thermal bonding or adhesive bonding. The thermal bonding refers to generating diffusion phenomenon in the diffusion layers on the surfaces of the plates attached with each other with high thermal energy, such that the plates are bonded with each other. The adhesive bonding refers to applying glue between each plate and heating or pressing the plate structures to bond the plates with each other. A plate bonding technology disclosed in U.S. Pat. No. 6,584,687 is bonding each plate by heating or pressing with a thermally fusible film.

In the conventional thermal bonding method, a diffusion layer must be fabricated first on the plate, such that diffusion bonding can be performed when the plates are bonded with each other, and thus the process is much complicated and the cost is increased. In addition, as for the ink jet head with fluid passages of a complicated shape, the adoption of the thermal bonding method tends to cause poor bonding between each plate, which may result in the leakage of ink from the gaps between the plates, thus significantly affecting the ink jet quality.

In the conventional adhesive bonding method, the glue for adhering the plates is likely to overflow from the plates due to excessively high temperature, non-uniform pressure, excessive amount of glue and the like, thereby causing blockage of the jet hole, waste of the resource and increase of the cost. Moreover, in the adhesive bonding method, it is likely that the structure of a portion of each plate cannot bear the process of heating or pressing, thus causing deformation or damage to the structure, such that the quality and function of the ink jet head is significantly affected.

SUMMARY OF THE INVENTION

In view of the above problems, the present invention provides an ink jet head structure and an adhering method thereof, so as to eliminate the limitations or defects of the thermal bonding and adhesive bonding method in the prior art concerning complicated process, poor bonding of the structure, and overflowing of the glue from the structure.

In the ink jet head structure and adhering method thereof disclosed in the present invention, the ink jet head structure has an ink accommodated therein, and the ink is jetted with the operation of an actuator. The ink jet head structure of the present invention comprises a first substrate, a second substrate, a third substrate and a glue. The first substrate has a glue inlet and an ink inlet for ink to be injected in. The second substrate has a glue outlet and an ink outlet for the ink to be jetted out. The third substrate is sandwiched between the first substrate and the second substrate, and a reservoir communicating the ink inlet and the ink outlet to accommodate the ink is formed between the first, second and third substrates. A first fluid passage communicating with the glue inlet is disposed between the first substrate and the third substrate, and a second fluid passage communicating with the first fluid passage and the glue outlet is disposed between the second substrate and the third substrate. The glue injected from the glue inlet of the first substrate fills the first fluid passage and the second fluid passage, and overflows from the glue outlet, so as to bond the first, second and third substrates.

The advantage of the present invention lies in that fluid passages having preset patterns are formed on each substrate of the ink jet head structure, such that the glue injected in the fluid passages may completely fill the fluid passages and will not overflow from each substrate, and thus the bonding effect is uniform and each substrate can be firmly bonded. In addition, the ink accommodated in the inkjet head structure is not easy to leak from the gaps generated due to poor bonding, thus forming the ink jet head structure with preferable ink jet quality.

The above illustration of the content of the present invention and the following description of the embodiments are used to demonstrate and explain the principle of the present invention and provide further explanations of the claims of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only for, and which thus is not limitative of the present invention, and wherein.

DETAILED DESCRIPTION OF THE INVENTION

Figure 1A:
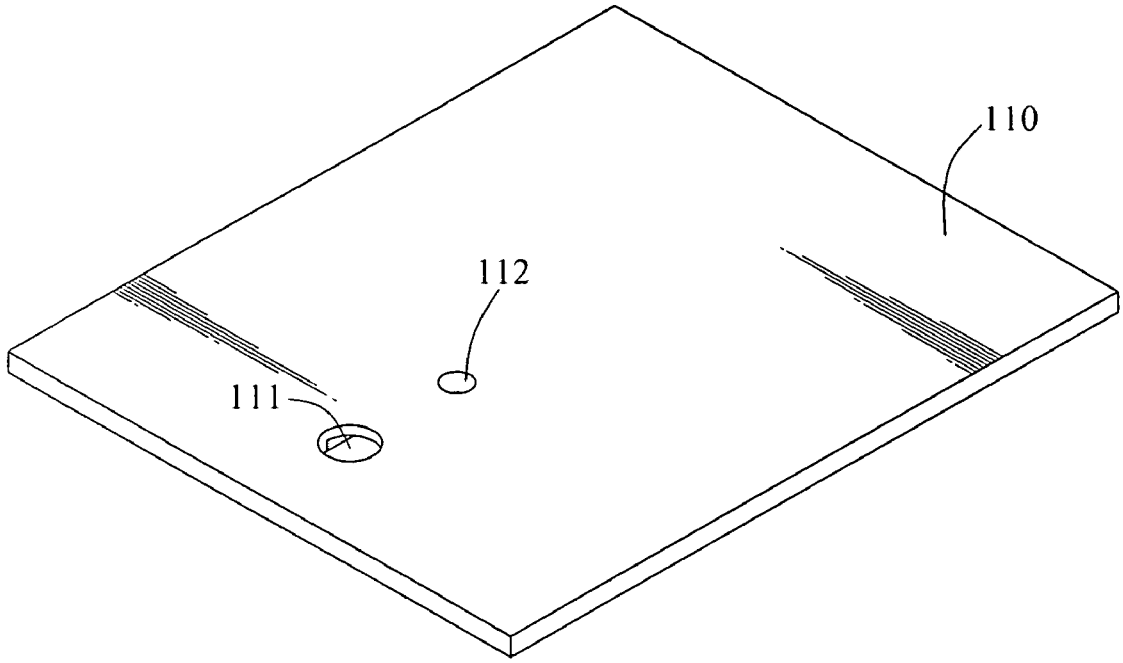
FIG. 1A is a top view of the first substrate according to the first embodiment of the present invention.
Figure 1B:
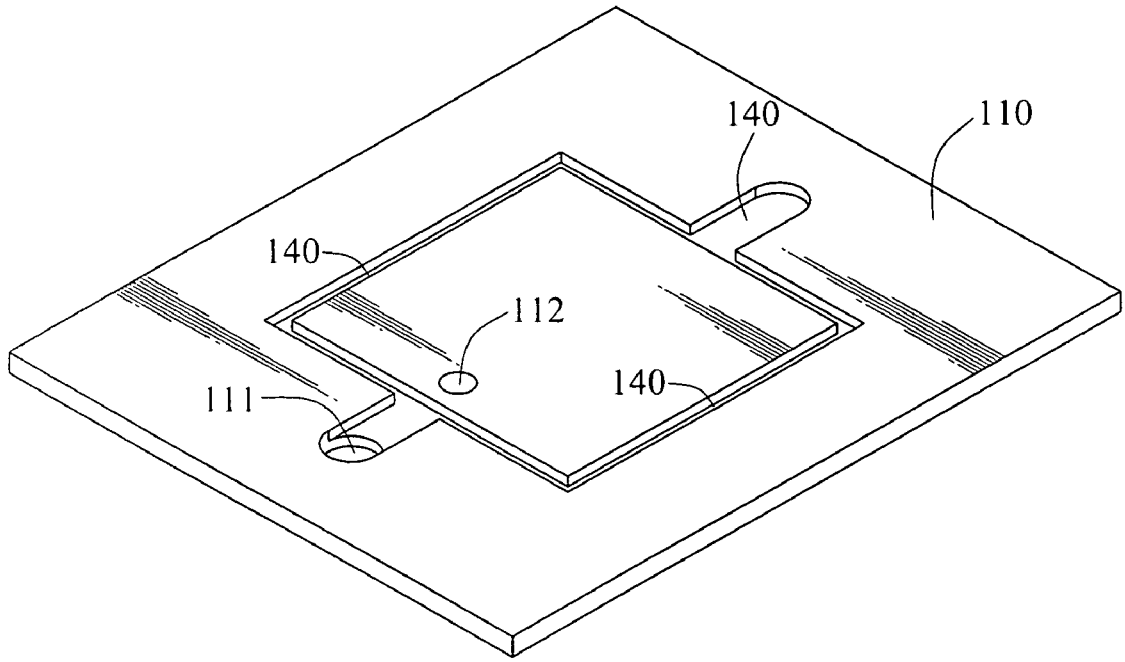
FIG. 1B is a bottom view of the first substrate according to the first embodiment of the present invention.
Figure 2A:
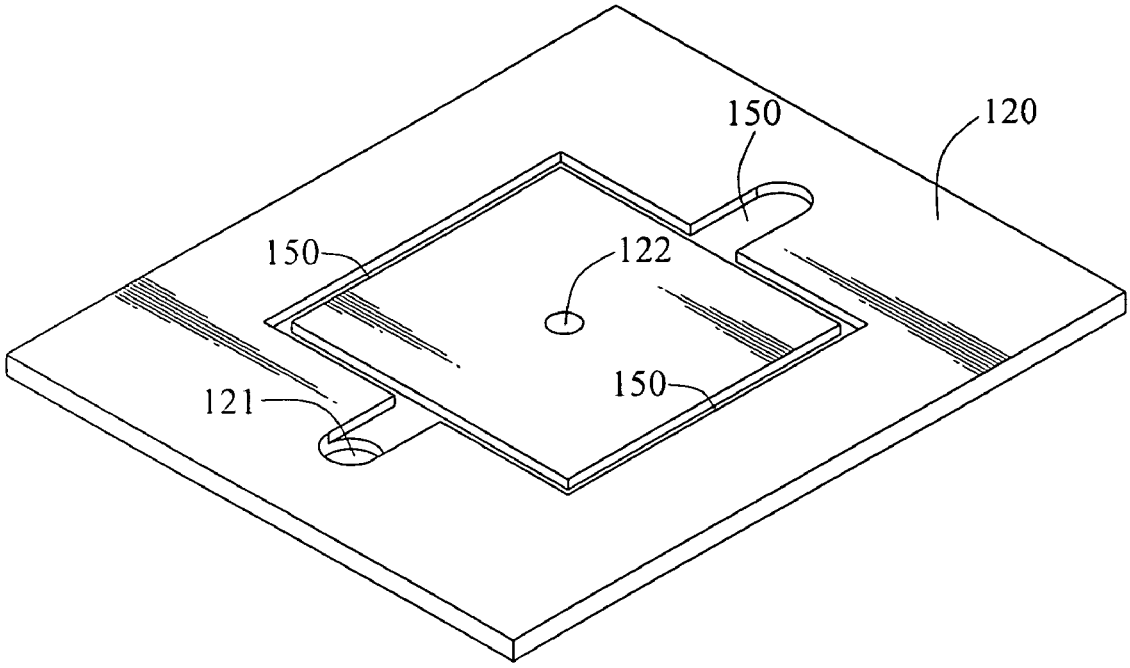
FIG. 2A is a top view of the second substrate according to the first embodiment of the present invention.
Figure 2B:
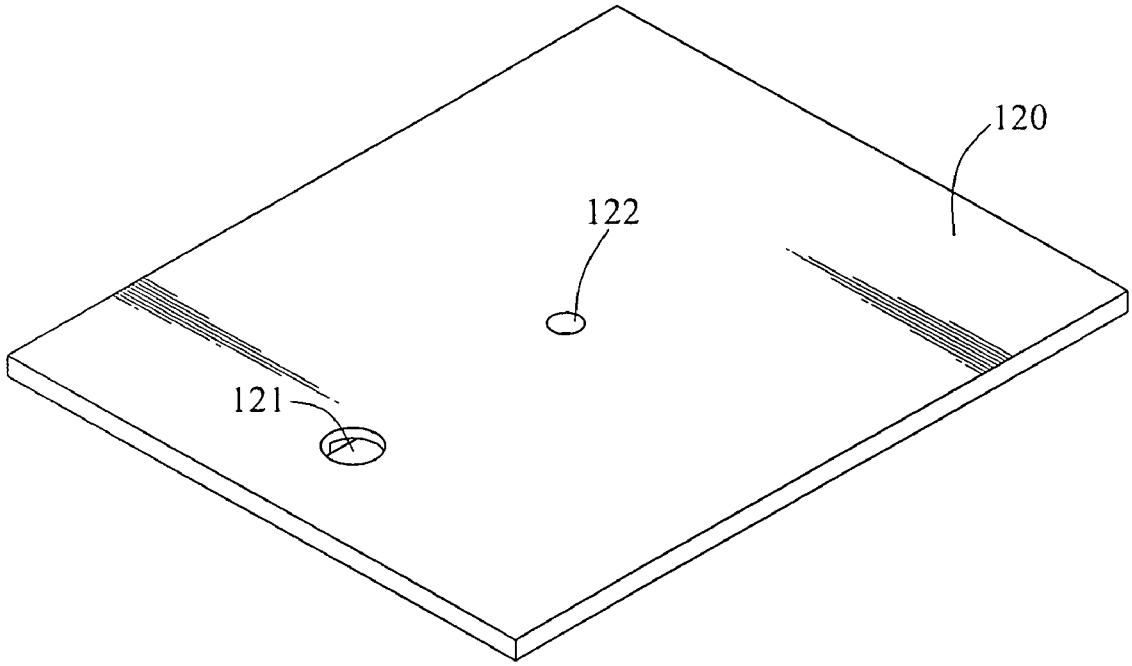
FIG. 2B is a bottom view of the second substrate according to the first embodiment of the present invention.
Figure 3:
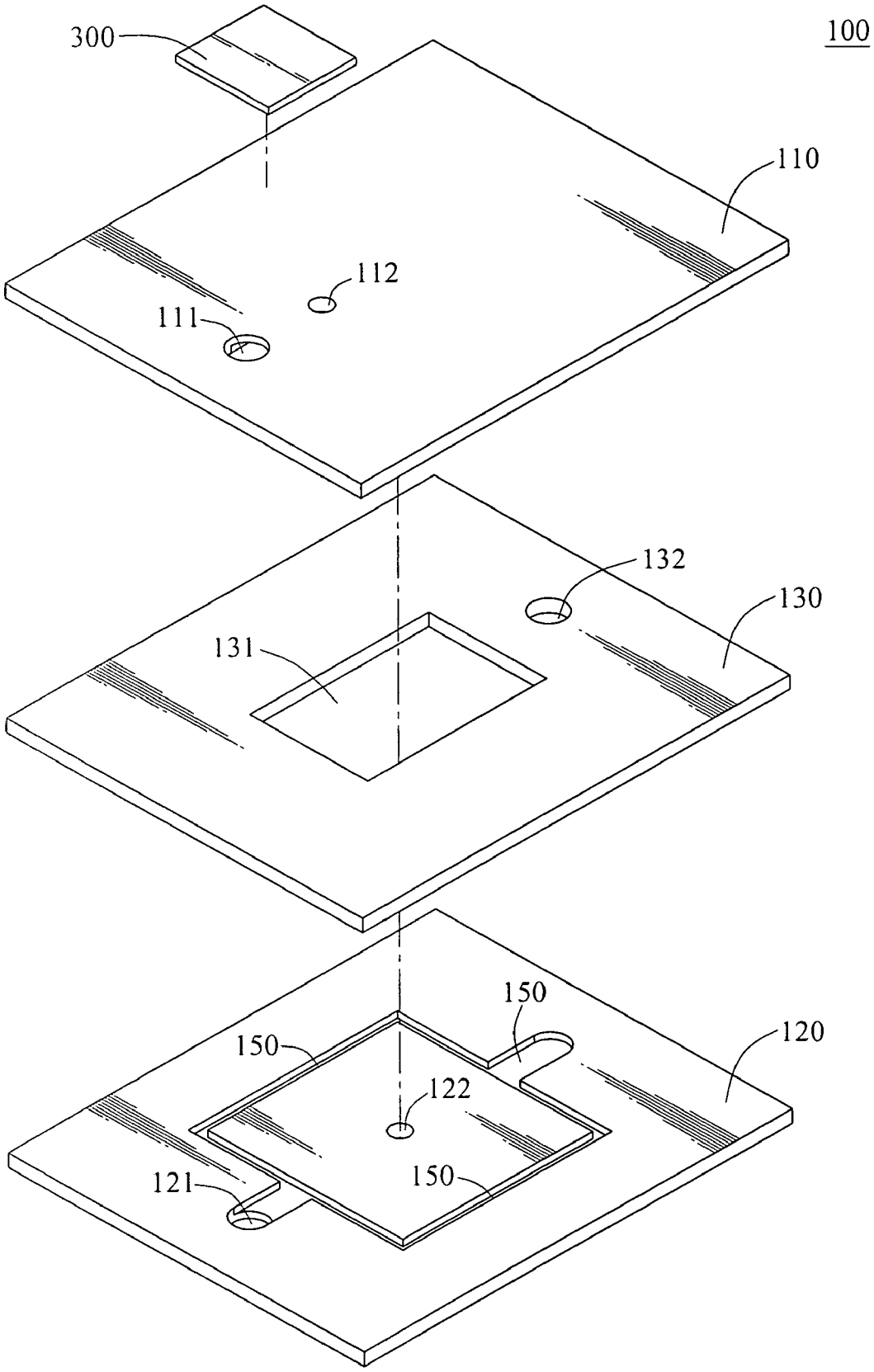
FIG. 3 is an exploded stereogram of the first embodiment according to the present invention.

Please refer to FIGS. 1A to 4B and FIG. 13 of schematic views and flow charts of the first embodiment according to the present invention. As shown in FIGS. 1A to 4B and FIG. 13, the ink jet head structure 100 of the present invention has an ink 200 accommodated therein, and the ink 200 is jetted with the operation of an actuator 300. The adhering method of the ink jet head structure 100 of the present invention includes the following steps. A first substrate 110 is provided (Step 400). A second substrate 120 (Step 410), a third substrate 130 and a glue 160 are provided. The first substrate 110 has a glue inlet 111 for the glue 160 to be injected in and an ink inlet 112 for the ink 200 to be injected into the ink jet head structure 100. The second substrate 120 has a glue outlet 121 for the glue 160 to overflow and an ink outlet 122 for the ink 200 to be jetted out. The third substrate 130 is sandwiched between the first substrate 110 and the second substrate 120 (Step 420). A reservoir 131 communicating the ink inlet 112 and the ink outlet 122 to accommodate the ink 200 injected from the ink inlet 112 is formed between the first substrate 110, the second substrate 120 and the third substrate 130. A first fluid passage 140 communicating with the glue inlet 111 is disposed between the first substrate 110 and the third substrate 130, and a second fluid passage 150 communicating with the first fluid passage 140 and the glue outlet 121 is disposed between the second substrate 120 and the third substrate 130. The glue 160 is injected from the glue inlet 111 (Step 430), such that the glue 160 fills the first fluid passage 140 and the second fluid passage 150, and overflows from the glue outlet 121 of the second substrate 120. The glue 160 is then cured (Step 440), so as to bond the first substrate 110, the second substrate 120 and the third substrate 130. Finally, the ink 200 is injected form the ink inlet 112, such that the ink 200 is stored in the reservoir 131, and is jetted from the ink outlet 122 with the operation of the actuator. The glue 160 disclosed in the present invention is an adhesive material from among thermoplastic adhesive material, thermocured adhesive material, photocured adhesive material and pressure sensitive adhesive material. Accordingly, the glue 160 is cured by heating, cooling or UV radiation according to the characteristic of each adhesive material, or applying pressure to the pressure sensitive adhesive material, so as to make the substrates 110, 120, 130 bonded with each other.

As shown in FIGS. 1A to 4B, the glue inlet 111 and glue outlet 121 are respectively disposed on one side of the first substrate 110 and the second substrate 120. The third substrate 130 further has a channel 132 communicating the first fluid passage 140 and the second fluid passage 150, and the channel 132 is disposed on the other side corresponding to the glue inlet 111 and the glue outlet 121. As such, the glue 160 flows through the first fluid passage 140 and the second fluid passage 150 with a largest flow area, thus making the first substrate 110, the second substrate 120 and the third substrate 130 firmly bonded with each other without being easily separated.

Furthermore, the first fluid passage 140 is formed on one side of the first substrate 110 opposite to the third substrate 130, the second fluid passage 150 is formed on one side of the second substrate 120 opposite to the third substrate 130, and the first fluid passage 140 and second fluid passage 150 are disposed surrounding the periphery of the reservoir 131, so as to form a largest fluid passage area, thereby making the first substrate 110, the second substrate 120 and the third substrate 130 firmly bonded with each other.

Figure 4A:
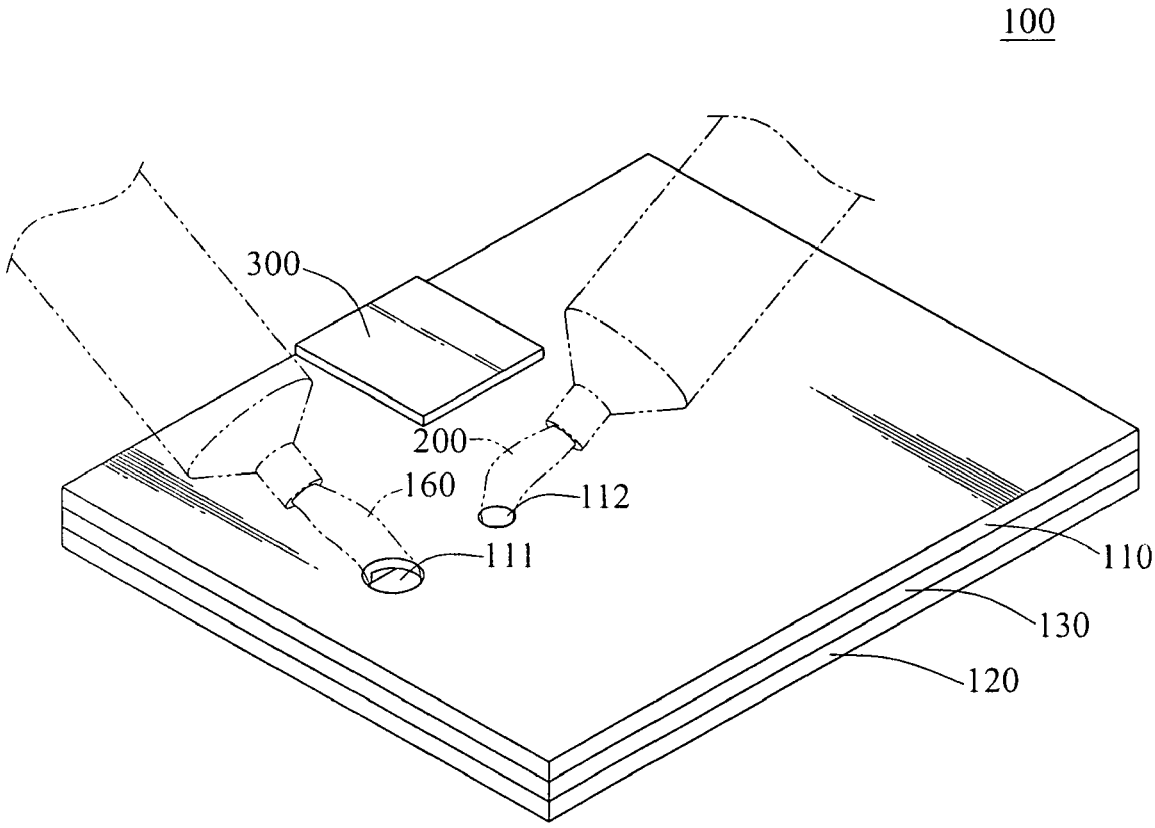
FIG. 4A is a combined stereogram of the first embodiment according to the present invention.
Figure 4B:
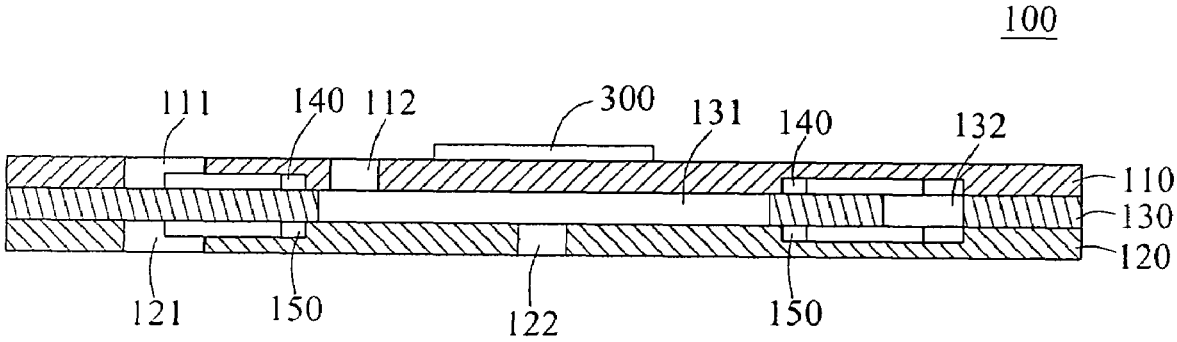
FIG. 4B is a schematic sectional view of the first embodiment according to the present invention.

In addition, as shown in FIG. 4A, the actuator 300 used in the present invention is made of piezo ceramic material, and an electrode (not shown) is disposed on the actuator 300. The free end of the piezo ceramic material is deformed due to shrinkage by the voltage applied externally to the electrode, such that the first substrate 110 bends laterally, thereby pressing the ink 200 stored in the reservoir 131, so as to make the ink 200 jetted from the ink outlet 122 under the pressure difference between the interior and exterior.

Figure 5A:
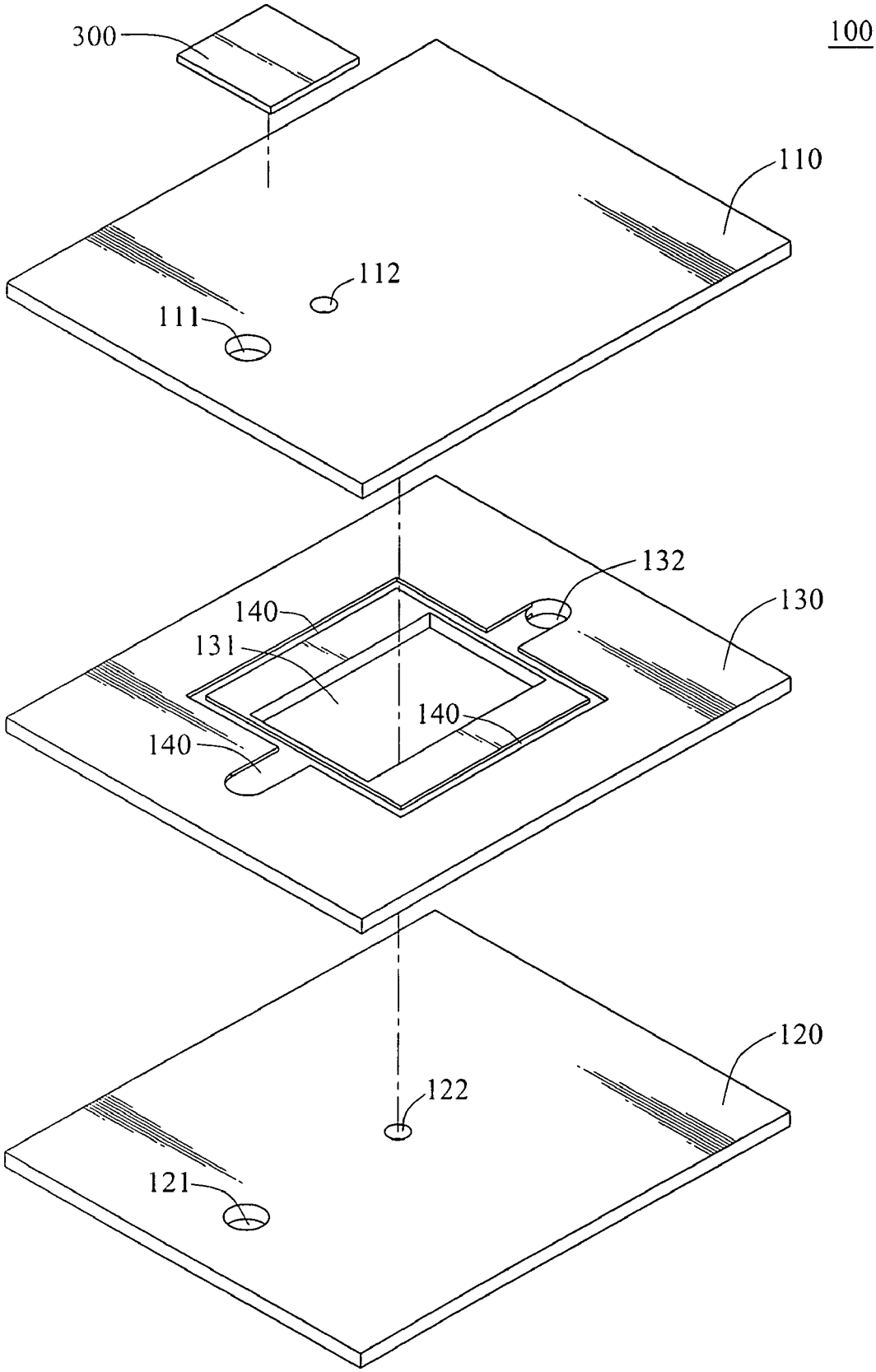
FIG. 5A is an exploded stereogram of the second embodiment according to the present invention.
Figure 5B:
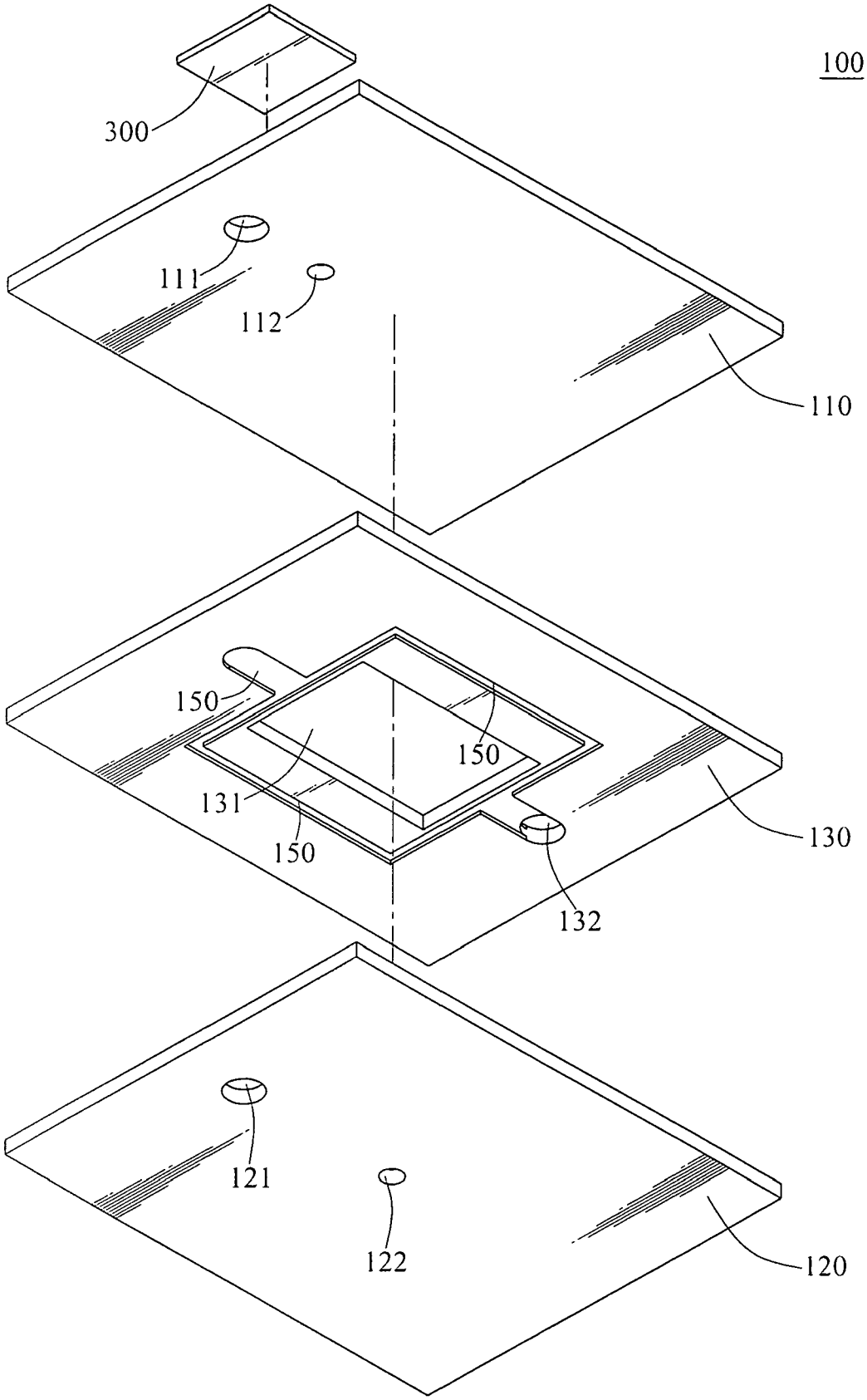
FIG. 5B is an exploded stereogram of the second embodiment according to the present invention after being inverted by 180 degrees.
Figure 5C:
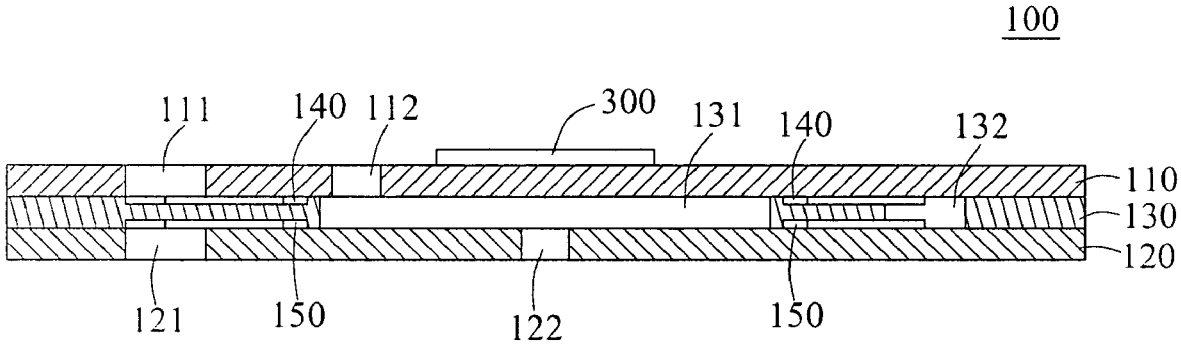
FIG. 5C is a schematic sectional view of the second embodiment according to the present invention.

Please refer to FIGS. 5A to 5C of schematic views of a second embodiment according to the present invention. As shown in FIGS. 5A to 5C, the first fluid passage 140 may further be formed on one side of the third substrate 130 opposite to the first substrate 110, and the second fluid passage 150 is formed on one side of the third substrate 130 opposite to the second substrate 120.

Figure 6A:
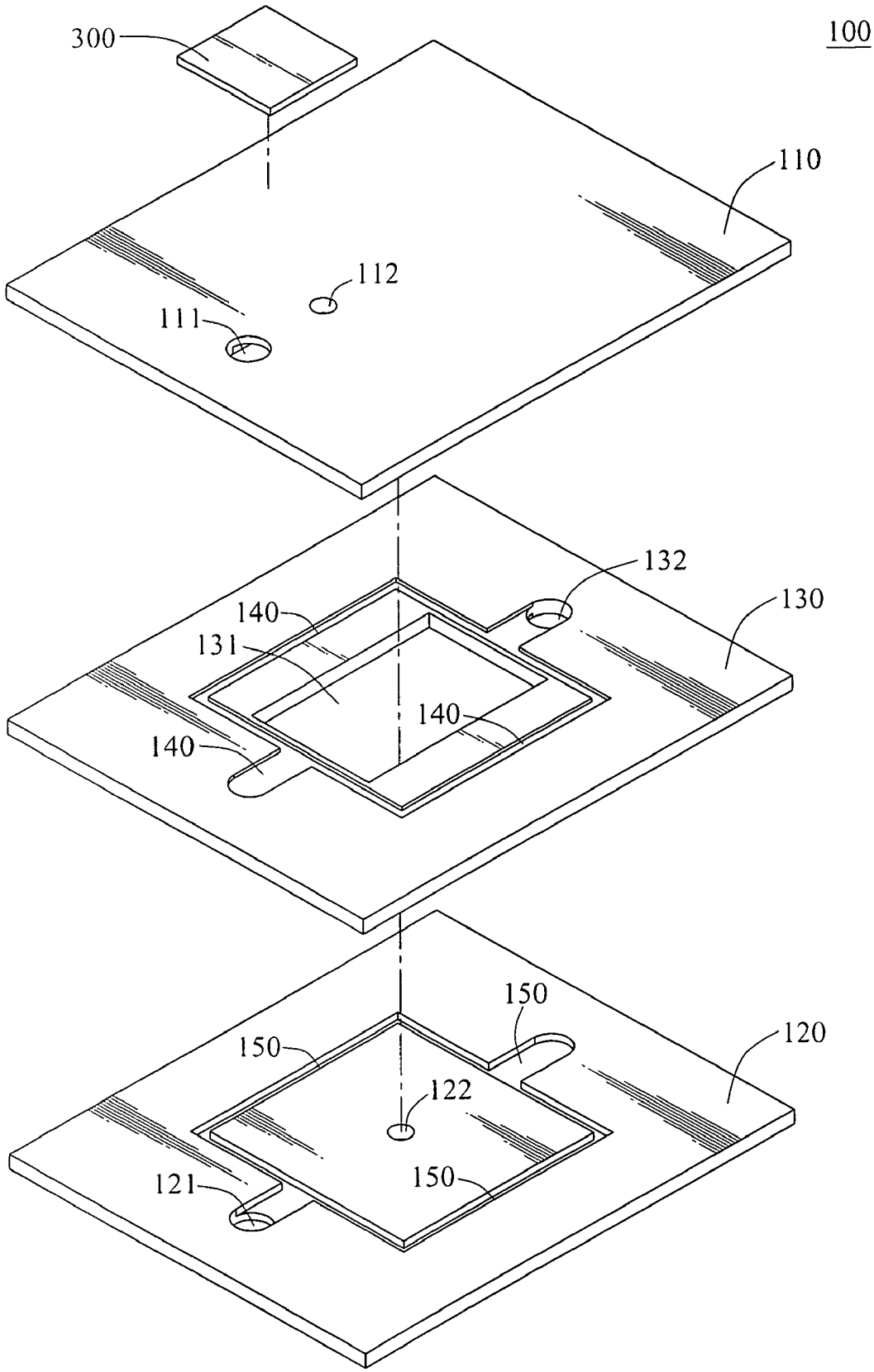
FIG. 6A is an exploded stereogram of the third embodiment according to the present invention.
Figure 6B:
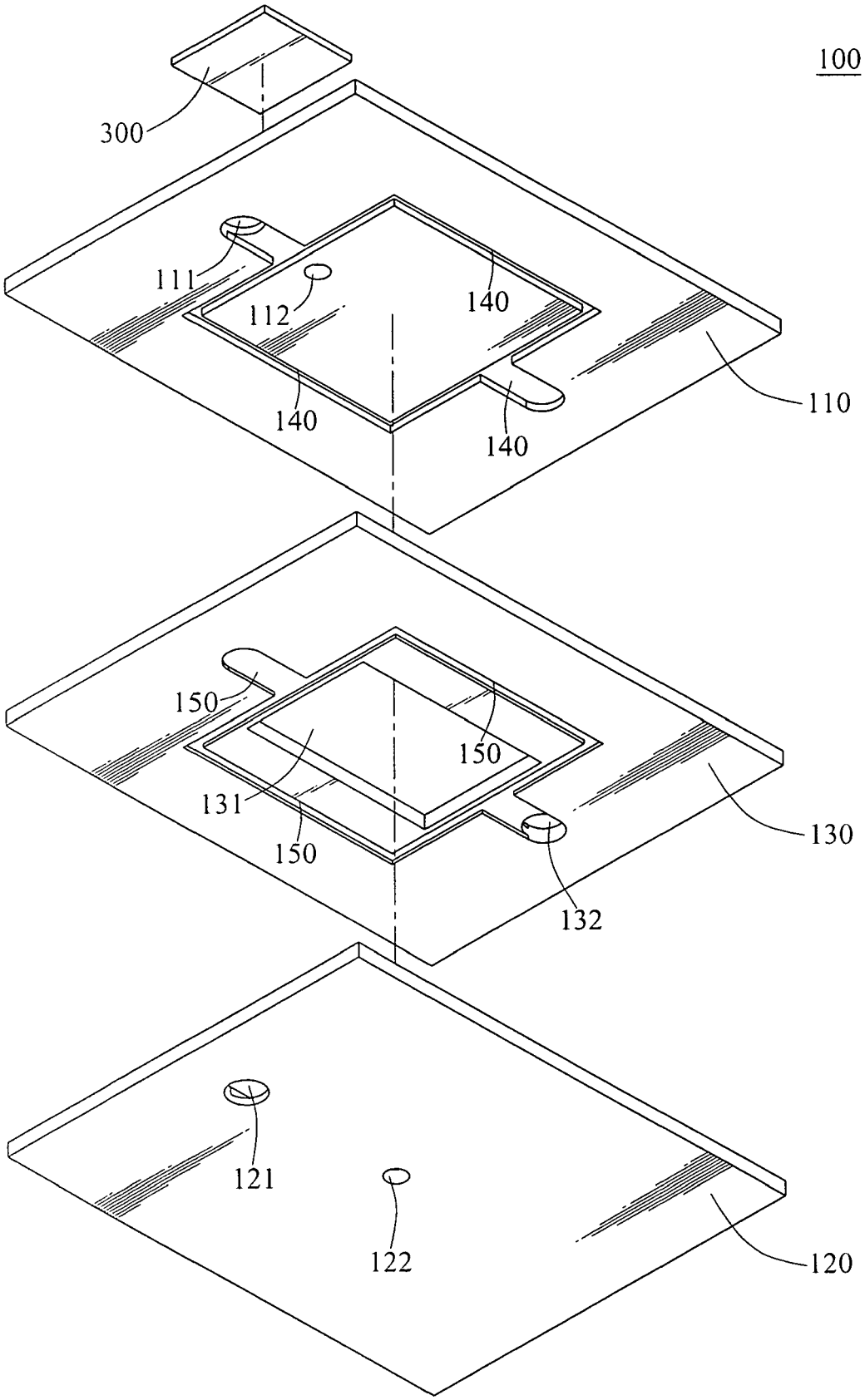
FIG. 6B is an exploded stereogram of the third embodiment according to the present invention after being inverted by 180 degrees.
Figure 6C:
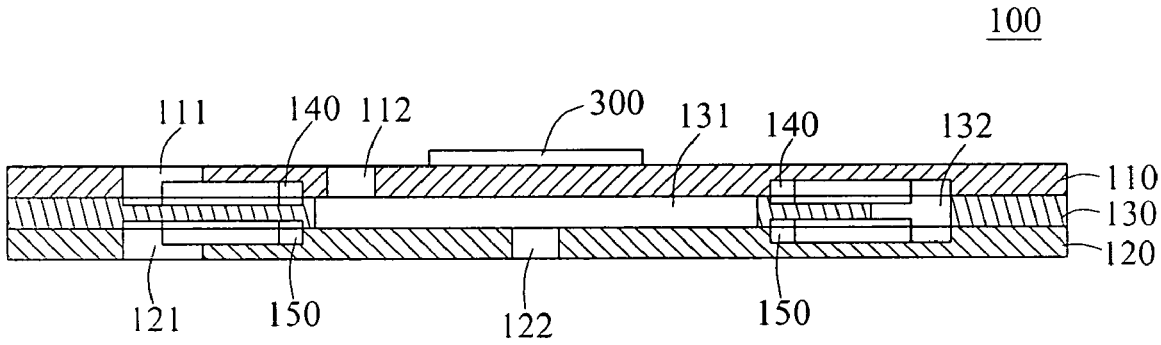
FIG. 6C is a schematic sectional view of the third embodiment according to the present invention.
Figure 7A:
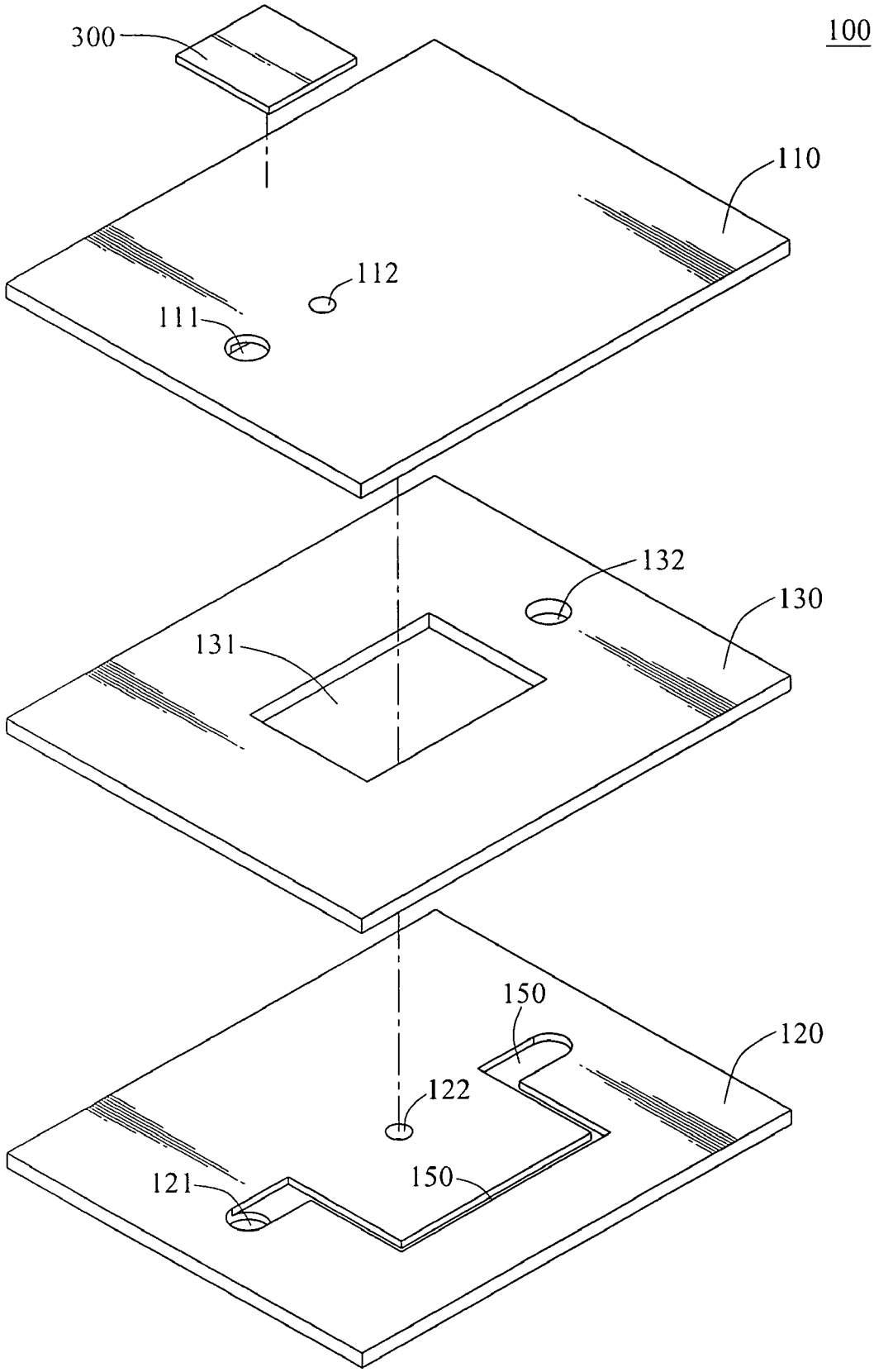
FIG. 7A is an exploded stereogram of different fluid passages according to the fourth embodiment of the present invention.
Figure 7B:
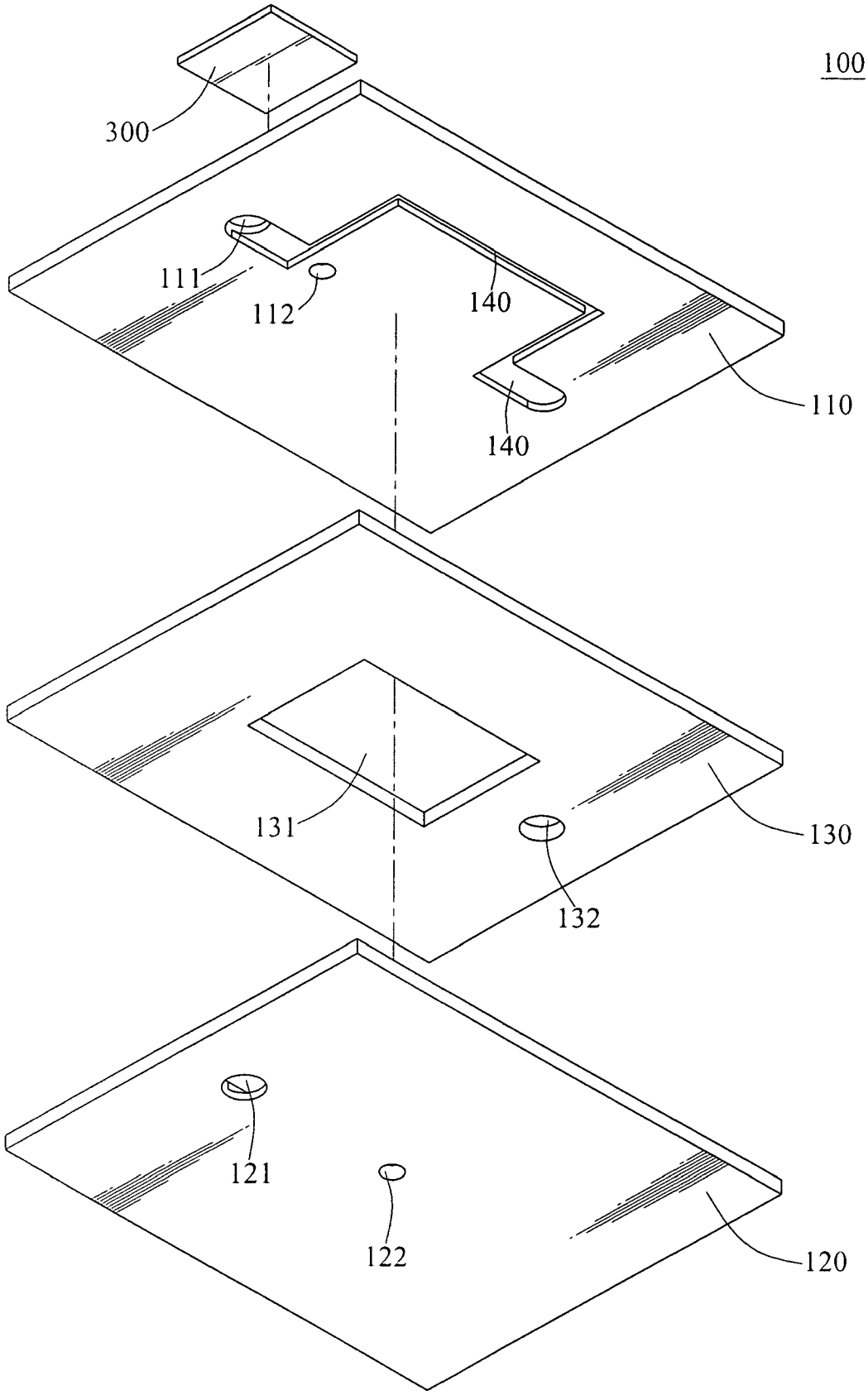
FIG. 7B is an exploded stereogram of different fluid passages according to the fourth embodiment of the present invention after being inverted by 180 degrees.
Figure 8A:
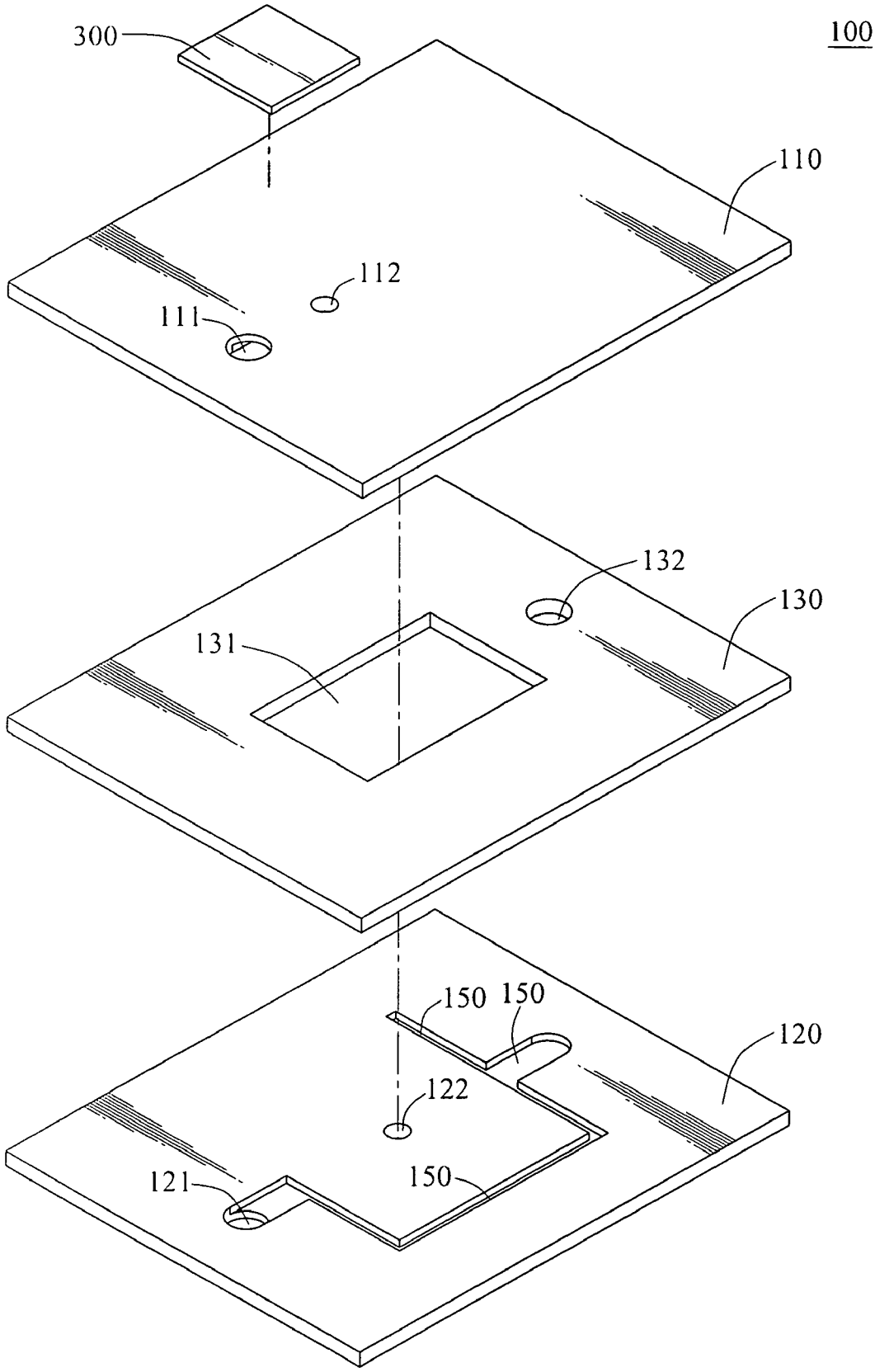
FIG. 8A is an exploded stereogram of different fluid passages according to the fifth embodiment of the present invention.
Figure 8B:
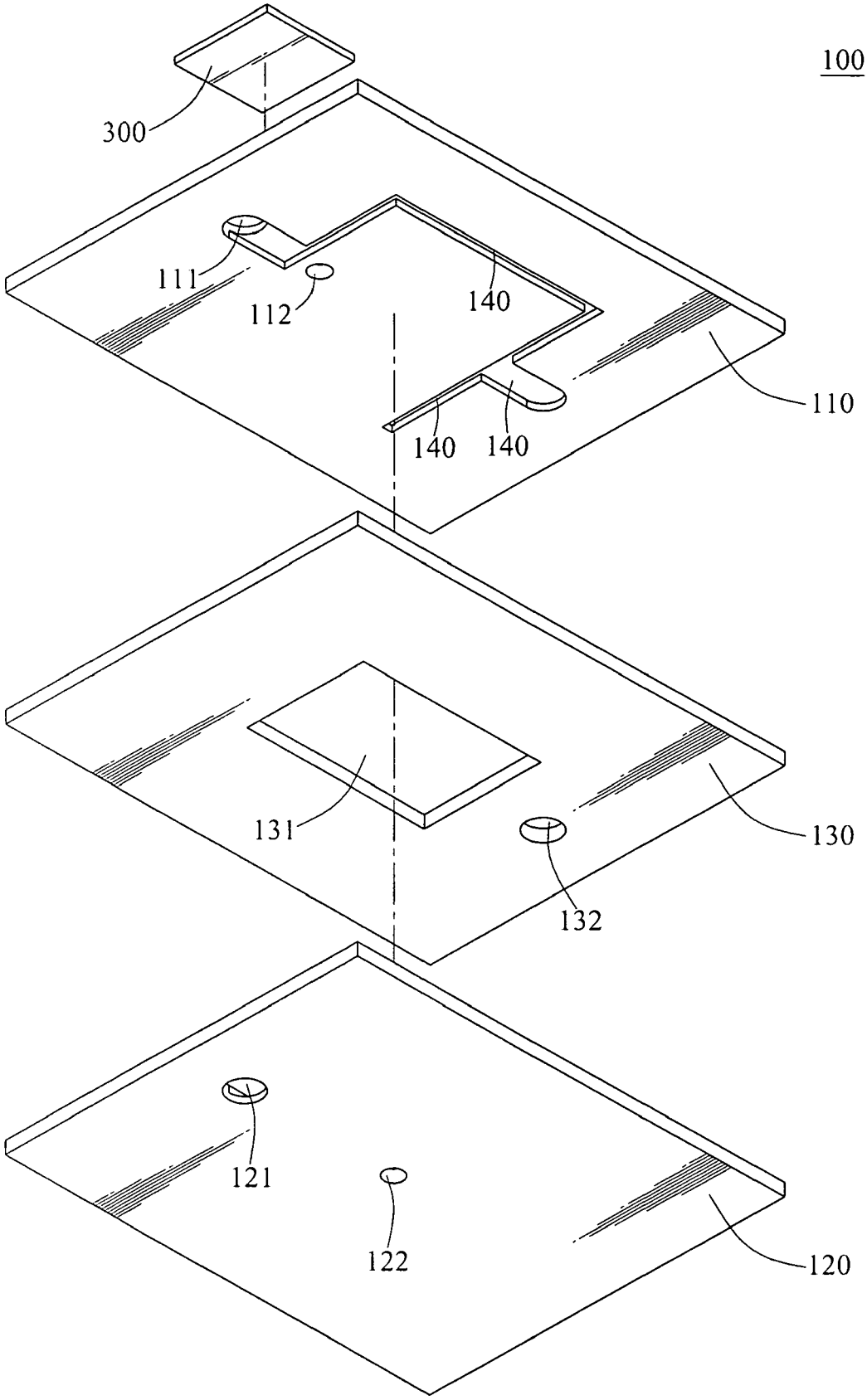
FIG. 8B is an exploded stereogram of different fluid passages according to the fifth embodiment of the present invention after being inverted by 180 degrees.
Figure 9A:
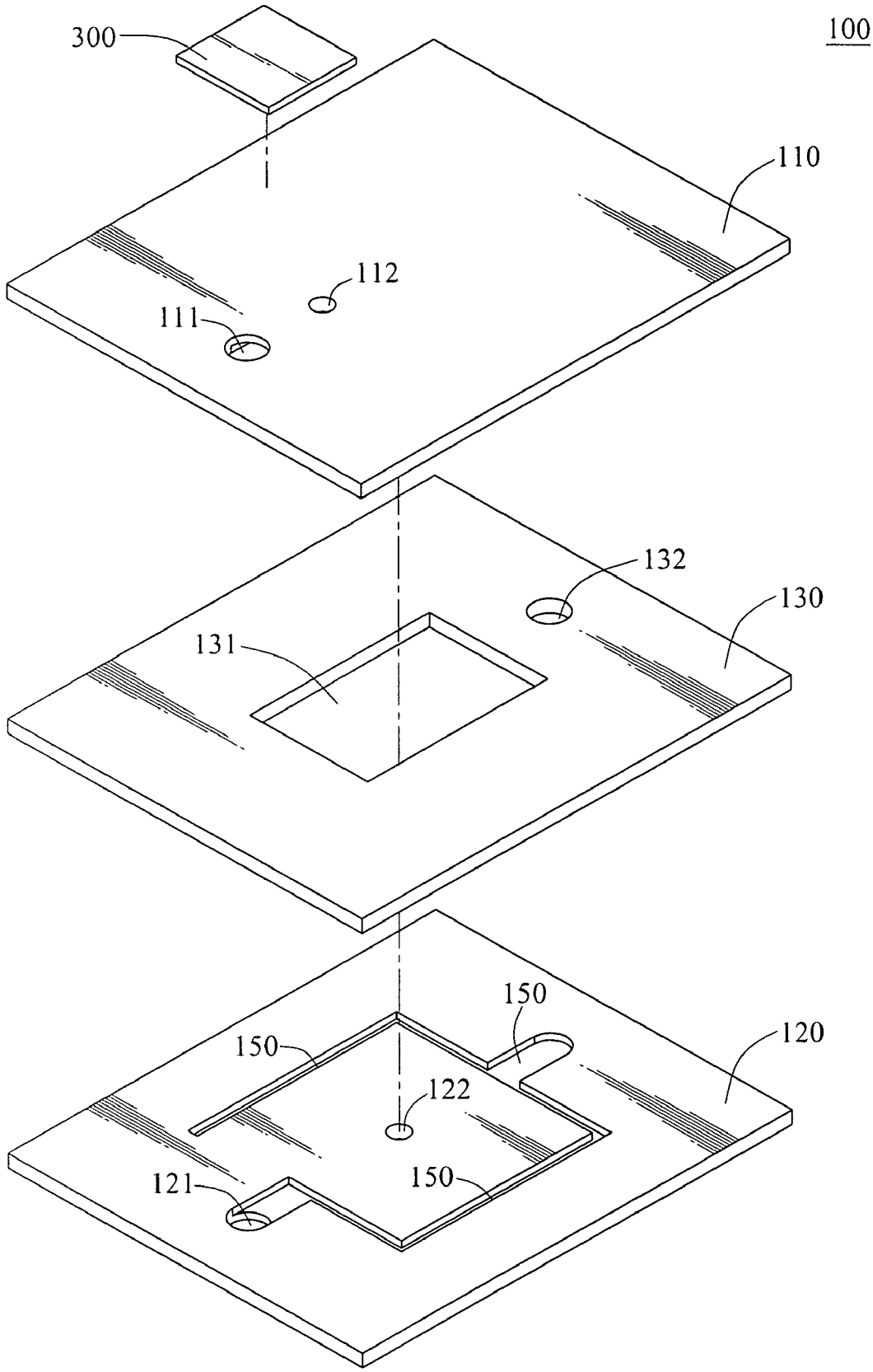
FIG. 9A is an exploded stereogram of different fluid passages according to the sixth embodiment of the present invention.
Figure 9B:
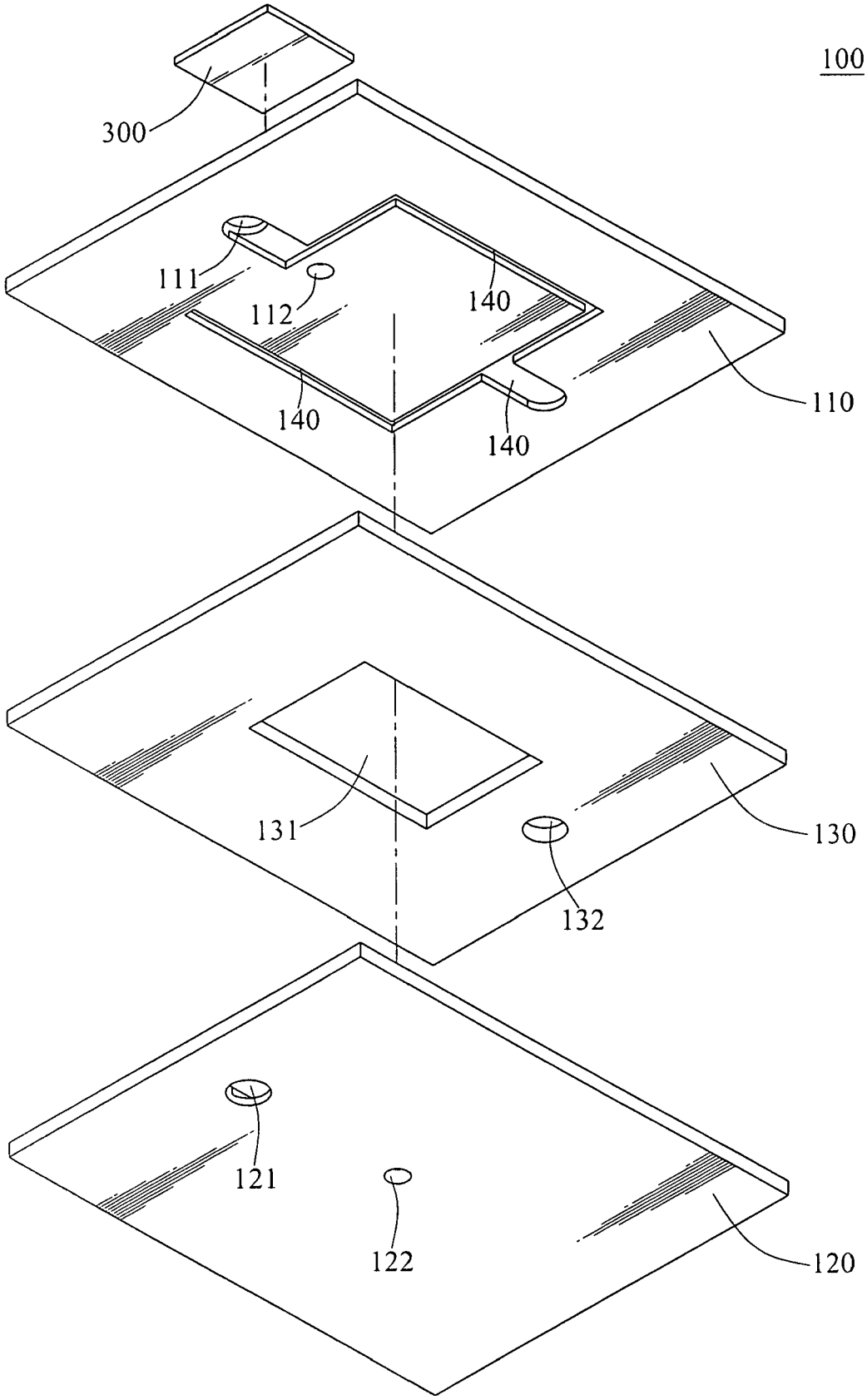
FIG. 9B is an exploded stereogram of different fluid passages according to the sixth embodiment of the present invention after being inverted by 180 degrees.
Figure 10A:
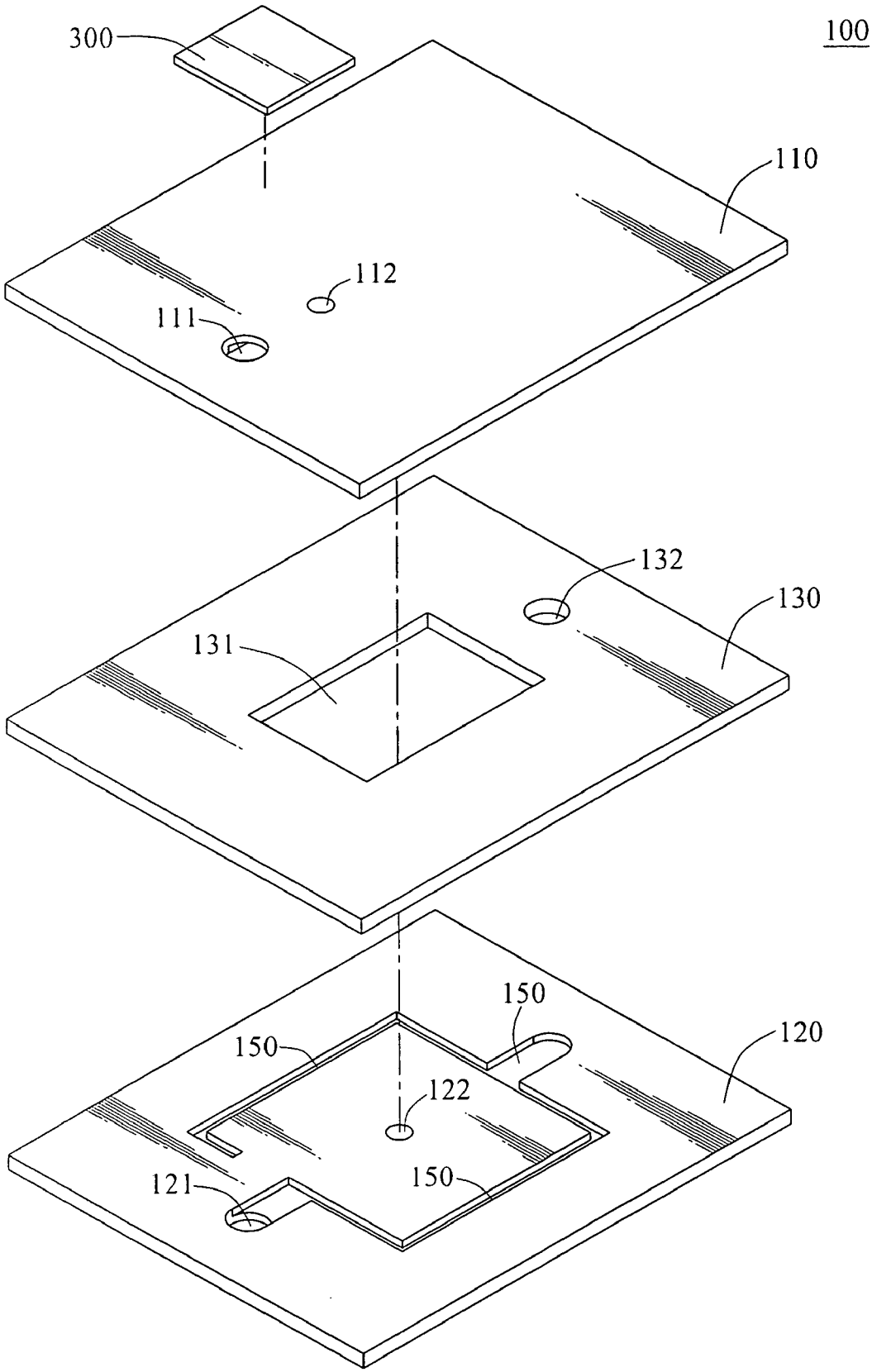
FIG. 10A is an exploded stereogram of different fluid passages according to the seventh embodiment of the present invention.
Figure 10B:
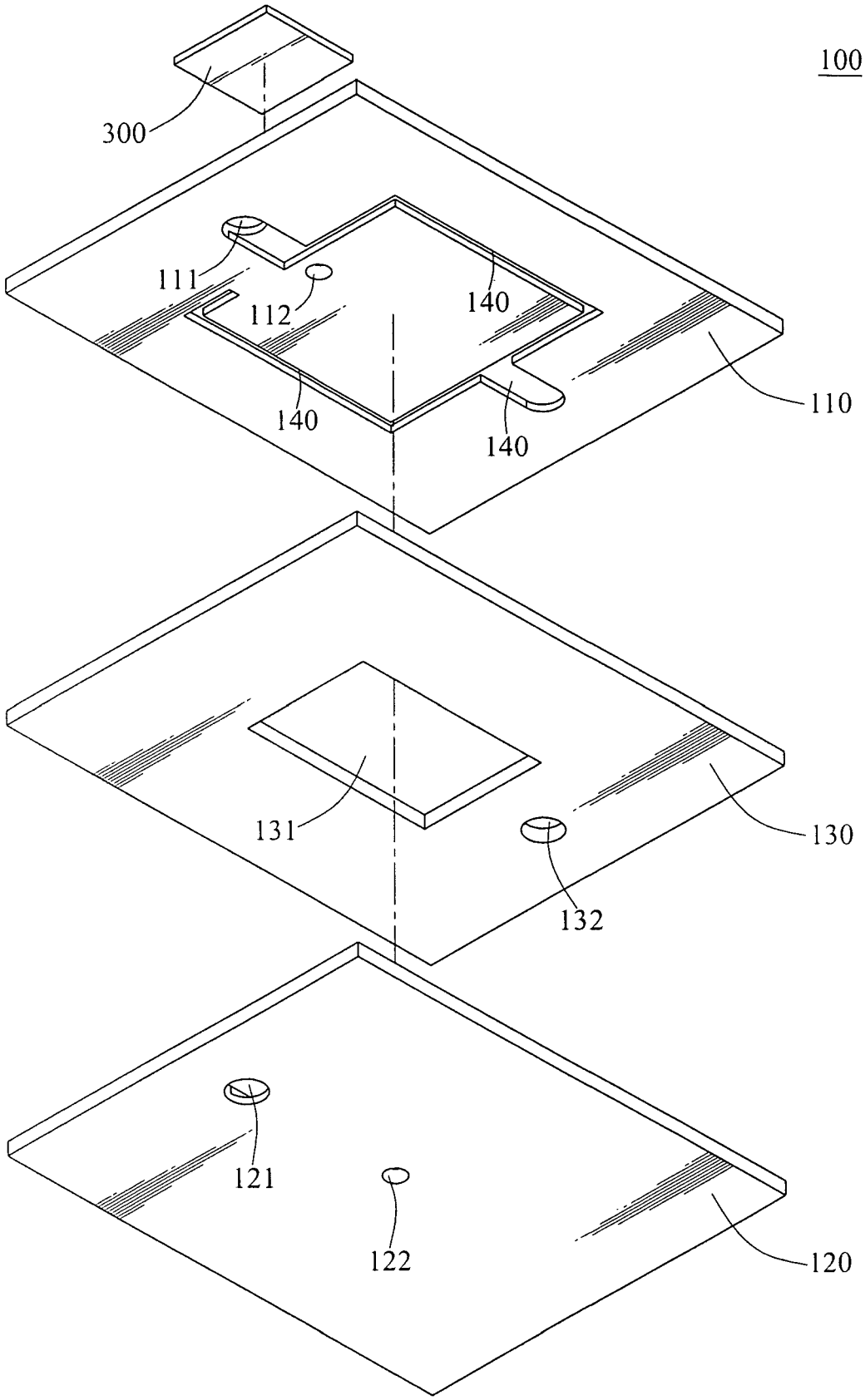
FIG. 10B is an exploded stereogram of different fluid passages according to the seventh embodiment of the present invention after being inverted by 180 degrees.

Please refer to FIGS. 6A to 6C of schematic views of a third embodiment according to the present invention. As shown in FIGS. 6A to 6C, the first fluid passage 140 is formed by combining the corresponding grooves on two opposite sides of the first substrate 110 and the third substrate 130, and the second fluid passage 150 is formed by combining the corresponding grooves on two opposite sides of the second substrate 120 and the third substrate 130.

Please refer to FIGS. 7A to 10B of schematic view of a fourth embodiment to a seventh embodiment according to the present invention. As shown in FIGS. 6A to 6C, the first fluid passage 140 and the second fluid passage 150 are respectively disposed near the reservoir 131. As for the fourth embodiment shown in FIGS. 7A and 7B, the first fluid passage 140 and the second fluid passage 150 are disposed near the reservoir 131 in a linear path. As for the fifth embodiment shown in FIGS. 8A and 8B, the first fluid passage 140 and the second fluid passage 150 surround the reservoir 131 in an L-shaped path, and are respectively disposed near the reservoir 131. As for the sixth embodiment shown in FIGS. 9A and 9B, the first fluid passage 140 and the second fluid passage 150 surround the reservoir 131 in a C-shaped path, and are respectively disposed near the reservoir 131. As for the seventh embodiment shown in FIGS. 10A and 10B, the first fluid passage 140 and the second fluid passage 150 surround the reservoir 131 in a non-continuous volute path, and are respectively disposed near the reservoir 131.

Figure 11A:
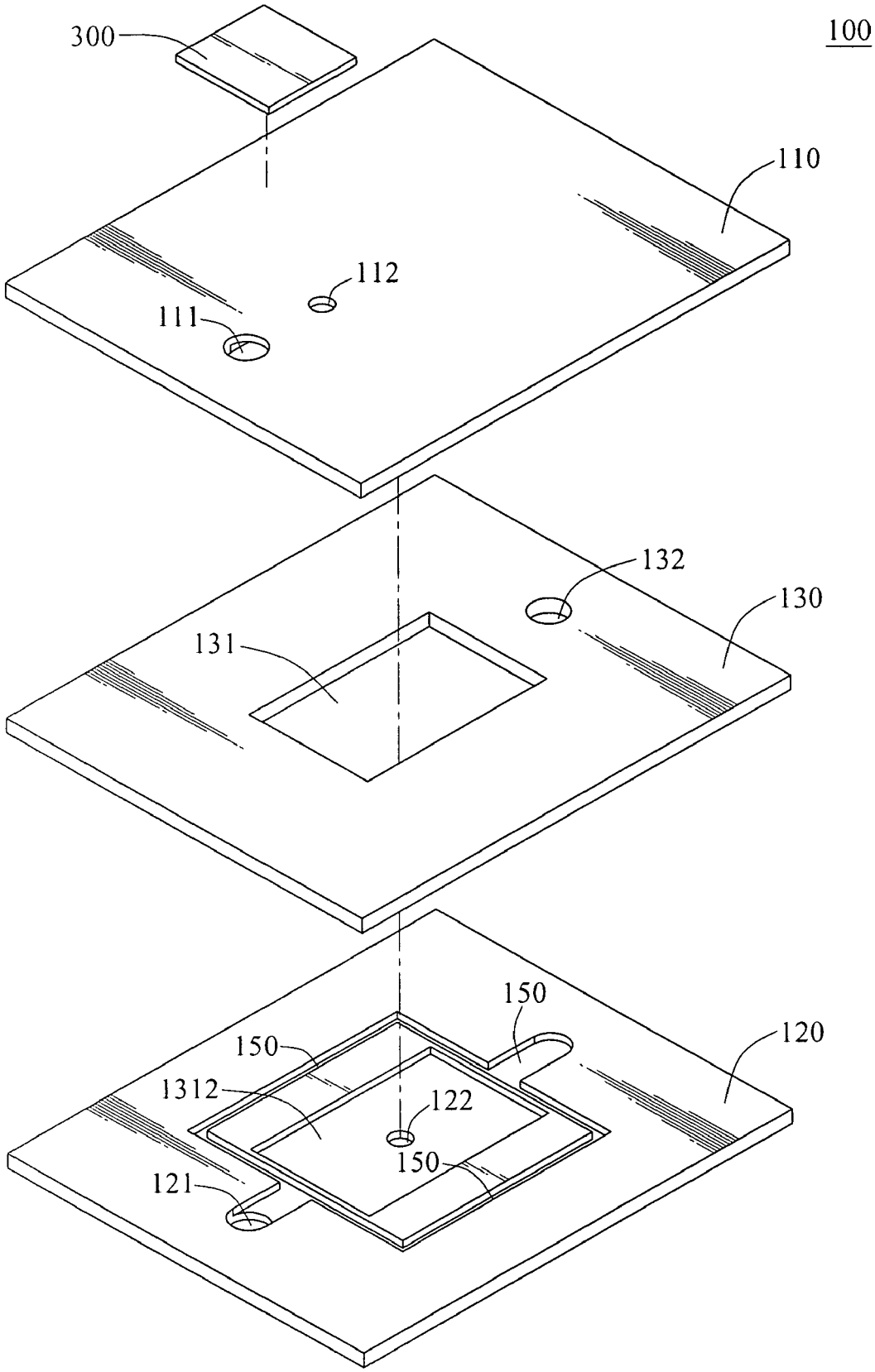
FIG. 11A is an exploded stereogram of the eighth embodiment according to the present invention.
Figure 11B:
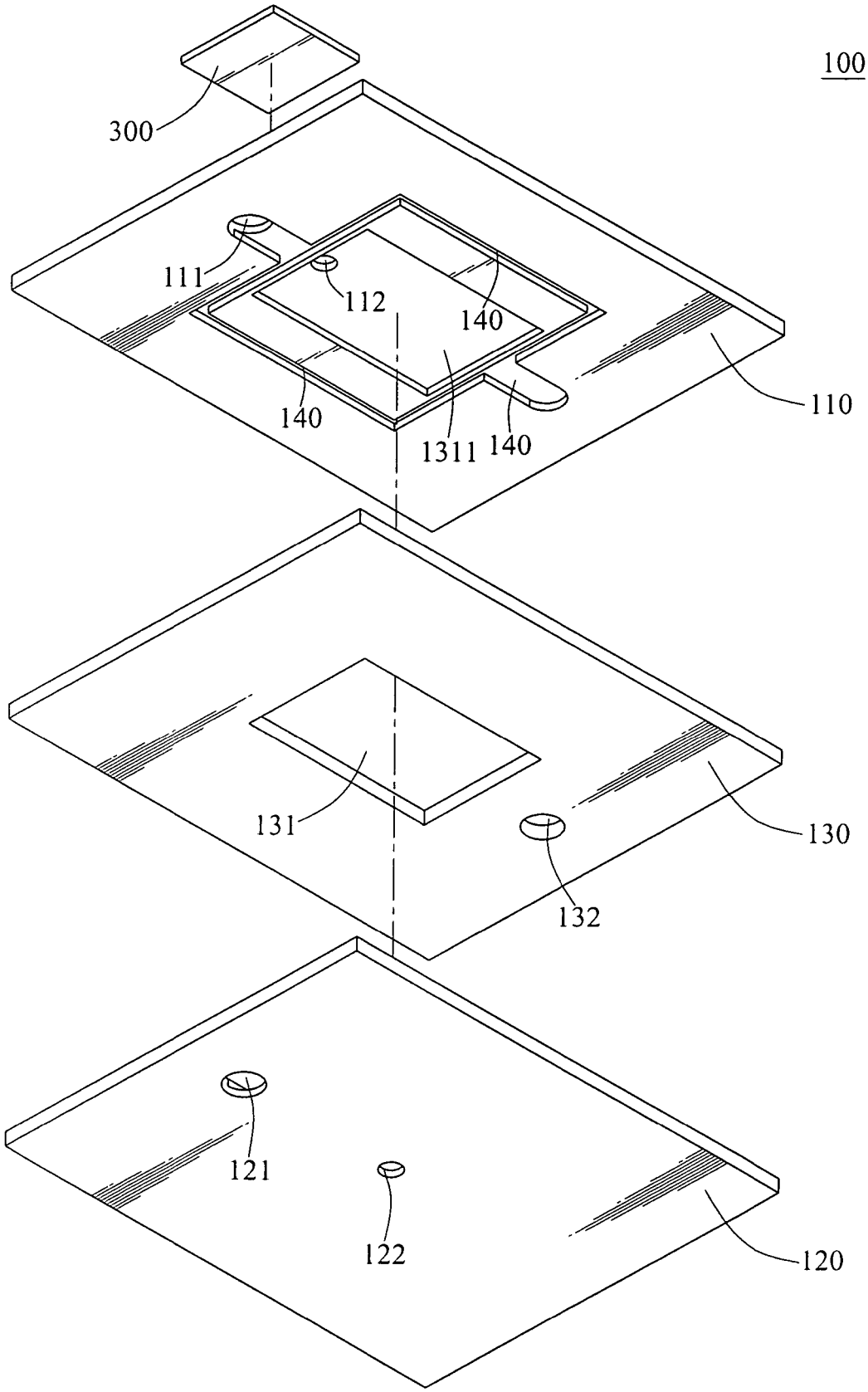
FIG. 11B is an exploded stereogram of the eighth embodiment according to the present invention after being inverted by 180 degrees.
Figure 11C:
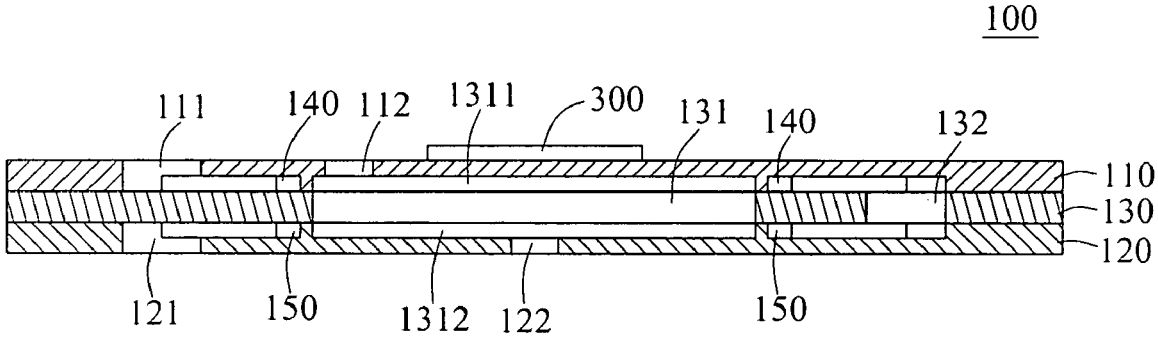
FIG. 11C is a schematic sectional view of the eighth embodiment according to the present invention.

Please refer to FIGS. 11A to 11C of schematic views of an eighth embodiment according to the present invention. As shown in FIGS. 1A to 11C, the reservoir 131 for storing the ink 200 is disposed on the third substrate 130. A first sub-reservoir 1311 may further be formed in the first substrate 110 at a position corresponding to the reservoir 131 of the third substrate 130, and the first sub-reservoir 1311 is communicated with the ink inlet 112. A second sub-reservoir 1312 may further be formed in the second substrate 120 at a position corresponding to the reservoir 131 of the third substrate 130, and the second sub-reservoir 1312 is communicated with the ink outlet 122. By respectively forming the first sub-reservoir 1311 and the second sub-reservoir 1312 in the first substrate 110 and the second substrate 120 at a position corresponding to the reservoir 131, the accommodation space in the ink jet head structure 100 for storing the ink 200 can be greatly enlarged.

Figure 12A:
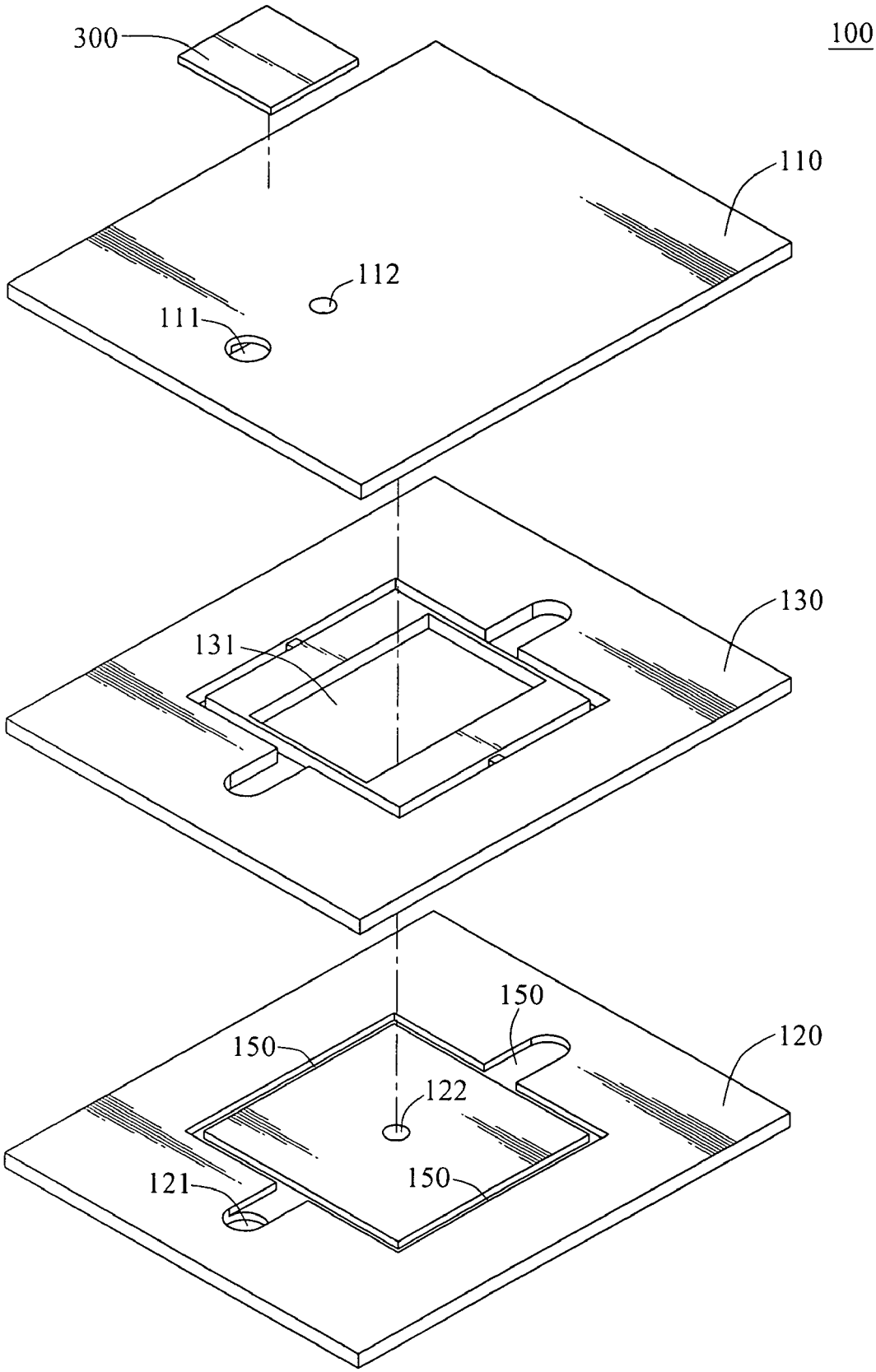
FIG. 12A is an exploded stereogram of the ninth embodiment according to the present invention.
Figure 12B:
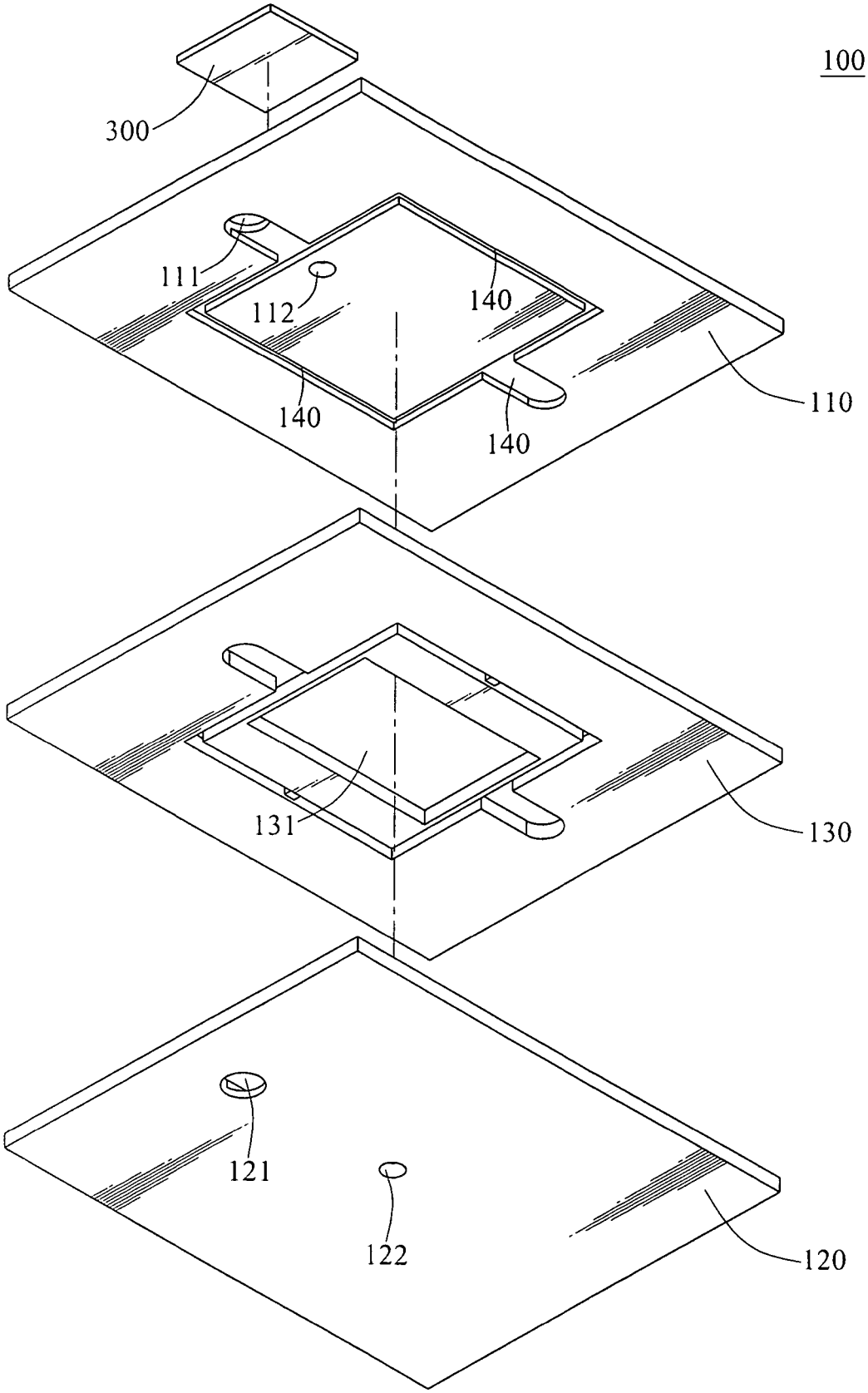
FIG. 12B is an exploded stereogram of the ninth embodiment according to the present invention after being inverted by 180 degrees.
Figure 12C:
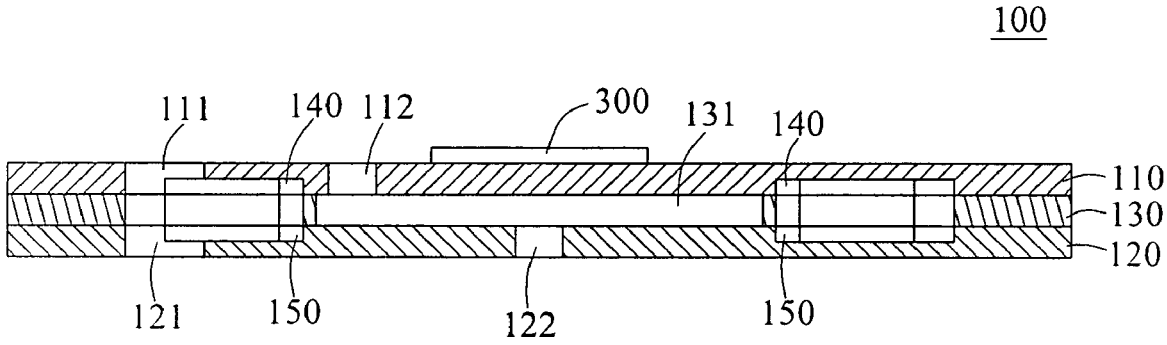
FIG. 12C is a schematic sectional view of the ninth embodiment according to the present invention.
Figure 13:
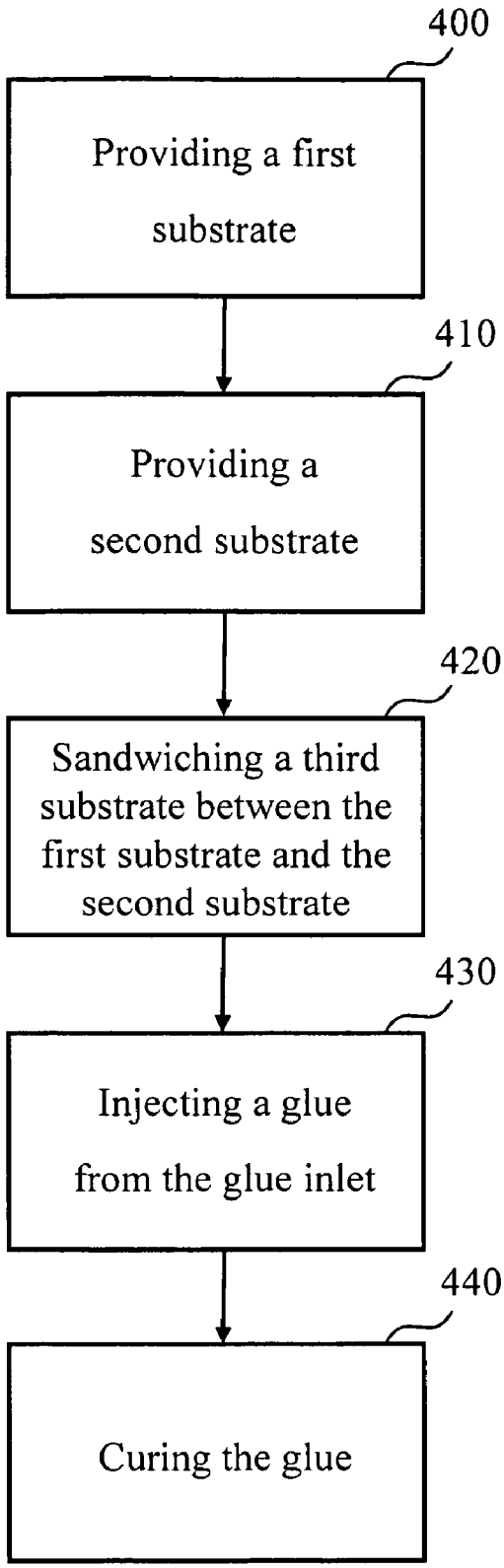
FIG. 13 is a flow chart of the processes of the present invention.

Please refer to FIGS. 12A to 12C of schematic views of a ninth embodiment according to the present invention. As shown in FIGS. 12A to 12C, the potions of the third substrate 130 corresponding to the first fluid passage 140 and the second fluid passage 150 are hollow-out, such that the first fluid passage 140 and the second fluid passage 150 form a same fluid passage passing through the third substrate 130. Therefore, when injected from the glue inlet 111, the glue 160 can directly fill the internal hollow-out portions, so as to achieve the purpose of bonding the first substrate 110, the second substrate 120 and the third substrate 130.

In comparison with the conventional art, in the present invention, fluid passages having preset patterns are formed on each substrate of the ink jet head structure, such that the glue injected into the fluid passages may completely fill the fluid passages without overflowing from the substrate, so as to firmly bond each substrate. Therefore, the accommodated ink is not easy to leak, thus forming an ink jet head structure of preferred quality.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet head structure, having an ink accommodated therein, and jetting the ink with the operation of an actuator, the ink jet head structure comprising:

a first substrate, having a glue inlet and an ink inlet for the ink to be injected into the ink jet head structure;

a second substrate, having a glue outlet and an ink outlet for the ink to be jetted out when the actuator operates;

a third substrate, sandwiched between the first substrate and the second substrate, wherein a reservoir communicating the ink inlet and the ink outlet is formed between the first, the second and the third substrates and is used to accommodate the ink, a first fluid passage communicating the glue inlet is disposed between the first substrate and the third substrate, and a second fluid passage communicating the first fluid passage and the glue outlet is disposed between the second substrate and the third substrate; and a glue, injected from the glue inlet, filling the first fluid passage and the second fluid passage, and overflowing from the glue outlet, for bonding the first, the second and the third substrates.

2. The ink jet head structure as claimed in claim 1, wherein the first fluid passage is formed on one side of the first substrate opposite to the third substrate.

3. The ink jet head structure as claimed in claim 1, wherein the first fluid passage is formed on one side of the third substrate opposite to the first substrate.

4. The ink jet head structure as claimed in claim 1, wherein the first fluid passage is formed by combining the corresponding grooves on two opposite sides of the first substrate and the third substrate.

5. The ink jet head structure as claimed in claim 1, wherein the second fluid passage is formed on one side of the second substrate opposite to the third substrate.

6. The ink jet head structure as claimed in claim 1, wherein the second fluid passage is formed on one side of the third substrate opposite to the second substrate.

7. The ink jet head structure as claimed in claim 1, wherein the second fluid passage is formed by combining the corresponding grooves on two opposite sides of the second substrate and the third substrate.

8. The ink jet head structure as claimed in claim 1, wherein the reservoir is disposed on the third substrate.

9. The ink jet head structure as claimed in claim 8, wherein a first sub reservoir communicating with the ink inlet is further disposed in the first substrate at a position corresponding to the reservoir, and a second sub-reservoir communicating with the ink outlet is further formed in the second substrate at a position corresponding to the reservoir.

10. The ink jet head structure as claimed in claim 1, wherein the position of the glue inlet is corresponding to the position of the glue outlet.

11. The ink jet head structure as claimed in claim 10, wherein the third substrate further has a channel communicating the first fluid passage and the second fluid passage, and the channel is disposed on the other side opposite to the glue inlet and the glue outlet.

12. The ink jet head structure as claimed in claim 1, wherein the first fluid passage and the second fluid passage are the same fluid passage passing through the third substrate.

13. The ink jet head structure as claimed in claim 1, wherein the first fluid passage and the second fluid passage respectively surround the periphery of the reservoir.

14. The ink jet head structure as claimed in claim 1, wherein the first fluid passage and the second fluid passage are respectively disposed near the reservoir in a linear, an L-shaped, a C-shaped, or a volute path.

15. The ink jet head structure as claimed in claim 1, wherein the glue is selected from a group consisting of a thermoplastic adhesive material, a thermocured adhesive material, a photocured adhesive material, and a pressure sensitive adhesive material.

* * * * *